United States Patent [19]

Sterlacci

[11] Patent Number: 4,953,293

[45] Date of Patent: Sep. 4, 1990

[54] ELECTRICIAN'S UTILITY KNIFE

[76] Inventor: Dennis J. Sterlacci, P.O. Box 7043, Cumberland, R.I. 02864

[21] Appl. No.: 354,385

[22] Filed: May 19, 1989

[51] Int. Cl.[5] ..... B25F 3/00

[52] U.S. Cl. ..... 30/124; 30/151; 30/90.1; 30/162; 30/299; 7/107

[58] Field of Search ..... 30/299, 124, 151, 155, 30/90.1, 158, 162; 7/107, 118

[56] References Cited

U.S. PATENT DOCUMENTS 1,994,215 3/1935 Gaunt ..... 30/299

3,257,722 6/1966 Caine ..... 30/90.1

*Primary Examiner*—Douglas D. Watts

*Assistant Examiner*—Willmon Fridie, Jr.

*Attorney, Agent, or Firm*—Barlow & Barlow, Ltd.

[57] ABSTRACT

A utility knife for electricians has a handle member formed of two mating parts with a blade carrier therein that moves a blade in an out of a slot in an end wall. The handle member has an aperture in the end remote from the slot that has a slitting knife partially protruding therein for slitting "Romex" type cable. The handle also has a notch that partially intersects the blade for stripping insulation from a conductor. A hole is provided into which a bare conductor may be inserted and by bending the conductor, it may be formed into a curve for inserting the same under a screw terminal.

2 Claims, 1 Drawing Sheet

ELECTRICIAN'S UTILITY KNIFE

BACKGROUND OF THE INVENTION

This invention relates to a utility knife for electricians and, more particularly, to a tool that will cut the cable sheath and strip insulation from the wire and bend the end of the wire to an arcuate form.

One of the most widely used electrical cable is known as "Romex" which is a cable having generally two insulated conductor wire strands and a grounding wire all encased in a sheath or jacket. When using wire of this nature, it has been the general practice to take a knife and slit the jacket to expose the insulated wires and then suitably strip the wires with a wire stripper. The slitting of the jacket or sheath is not easily accomplished and one may readily slip and cut the wire insulation. To obviate this problem, there have been a number of tools provided in the art which generally utilize some form of a passageway into which a portion of a knife blade extends which will slit the cable centrally thereof. A typical tool that has such a construction with a passageway is seen in the Shannon U.S. Pat. No. 2,943,391 (30/90.6).

SUMMARY OF THE INVENTION

The present invention contemplates a combination utility knife cable and wire stripping tool that is formed from a common utility knife such as that seen in U.S. Pat. No. 3,107,426 and which has a passageway located at the end of the handle remote from the cutting blade. Extending into this passageway is a knife which has a sharp point that extends part of the distance there across for slitting sheathed cable. A notch is formed in the part of the handle that receives the blade and that notch has a depth that is sufficient to expose the cutting edge of the blade and this notch therefore serves as a stripping notch which allows one to strip the insulated wire by inserting the wire therein and simply pulling it after nicking the insulation so that the insulation will slide off the wire. In the preferred embodiment of the invention, the knife also is provided with a hole in the handle near the arcuate portion thereof so that by the insertion of a wire into the hole and bending the same about an arcuate portion of the handle, a loop of the proper dimension and size on the bare end of a conductor is formed so that the were may be secured under a terminal screw.

DETAILED DESCRIPTION OF THE PREFERRED EMBODIMENT

Figure 1:
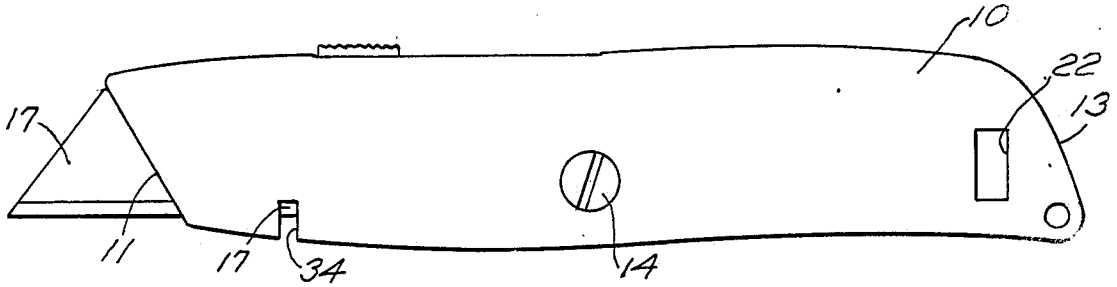
FIG. 1 is a elevational view of a knife made in accordance with the invention.

The combination utility knife tool of the present invention consists of two elongated handle members 10 and 12 which are detachably secured together as by a fastener 14 and which are separable along a longitudinal plane so as to form the two halves as is conventional with knives of this character. A blade carrier such as 16 is provided for a blade 17 that will move the blade longitudinally of the handle toward and away from a slot in the end wall 11. The handle is also provided with essentially a compartment 20 into which spare blades may be received.

Figure 2:
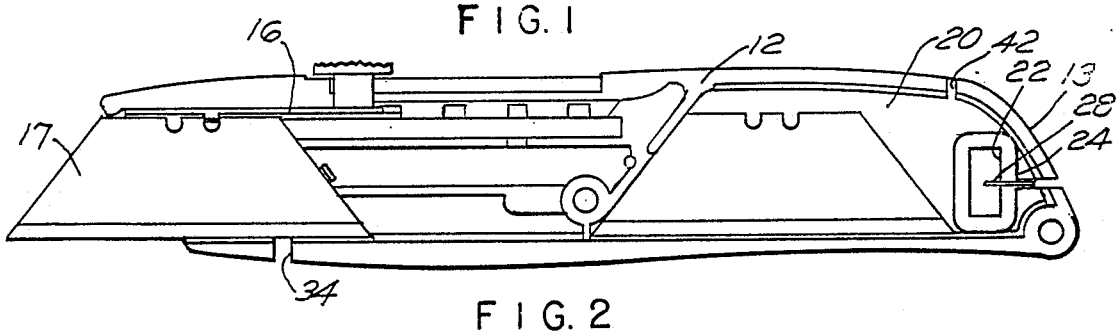
FIG. 2 is a nelevational view showing one half of the knife casing.
Figure 3:
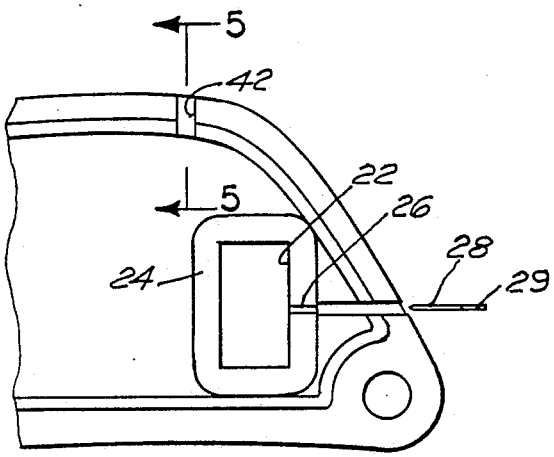
FIG. 3 is an enlarged view of one half of the casing showing the passageway.
Figure 4:
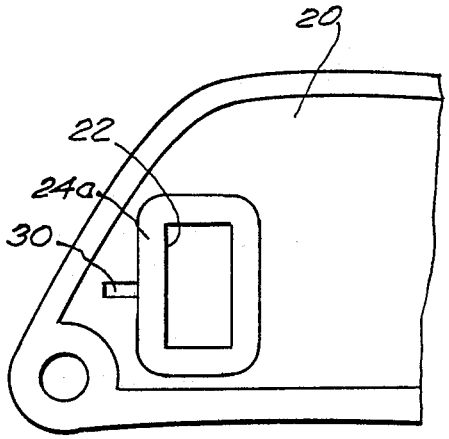
FIG. 4 is a similar view of the half of the casing.
Figure 6:
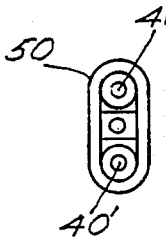
FIGS. 6 and 6A are plan and end views of "Romex" cable.
Figure 6A:
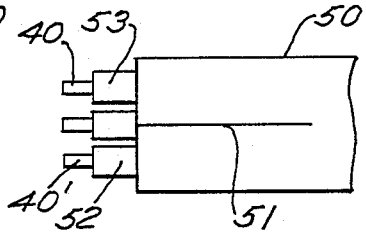
Figure 7:
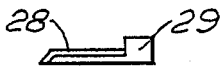
FIG. 7 is a view of the slitting knife.

Adjacent the end 13 of the handle an aperture 22 is formed a continuous wall 24 thereabout and, as seen in FIGS. 3 and 4, this wall 24 or 24*a* is in both halves of the handle and is generally oblong in shape to accept standard "Romex" type building wire as seen in FIG. 6 and 6A. In wall 24, there is a break so as to provide a slot 26 and into this slot a knife 28 may be inserted which knife has a right angular portion 29 (see FIG. 7) that extends upwardly as viewed in FIGS. 2 and 3 and will protrude into a recess 30 provided in the other half of the handle as seen in FIG. 4.

The handle 10 is also characterized by a slot 34 which extends transverse of the handle in the general area where the blade is received and is of a depth so that the edge of the blade is exposed across the slot as seen in FIG. 1 and 2. This slot 34 will serve as a means from stripping insulation from wire.

Figure 5:
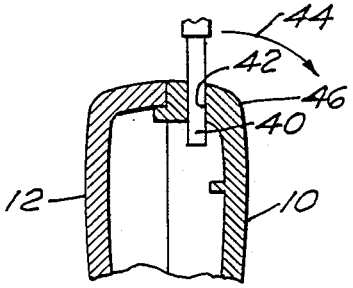
FIG. 5 is a sectional view taken on line 5—5 of FIG. 3.

By reference to FIG. 5, it will be observed that the handle portion 10 which can accept the bare end 40 of a wire which is inserted into a cavity 42 after the end has been stripped of its insulation. The wire is then bent as seen by the arrow 44 over the rounded shoulder edge 46 of the handle 10. This allows the bare end of the wire to be formed into a loop so that it may be received under the binding screw of a terminal.

By reference to FIG. 6, it will be seen that the "Romex" cable 50 has an outer sheath and when it is passed through the passageway 22, the knife 28 will take a cut such as 51 allowing one to utilize side cutters or a knife to further remove the insulation and permit the insulated conductors, such as 52, 53, to be exposed, which conductors can then be stripped by passing the same into the slot 34 to create the bare ends such as 40, 40'.

I claim:

1. In a utility knife for electricians a handle having two members detachably secured together and separated along a central longitudinal plane, a slot at one end of the handle, a blade carrier adjacent said end of one of the members mounted for movement, a blade held by said carrier to leave the cutting edge unobstructed, that improvement comprising a notch in the handle adjacent the said end of a depth to allow the blade to protrude therein and permit insulation on a wire to be cut, an oblong aperture in each of the members that form a transverse passageway for receiving sheath covered parallel electric cable, a cutting blade partially protruding into the passageway centrally thereof and on a plane perpendicular to the longitudinal extent of said members for engaging the sheath of electrical cable.

2. In a knife as in claim 1 wherein at least one of the members has rounded shoulder portions and a cavity is formed in the member at a location where the shoulder portions extend in an arcuate path therefrom, said cavity receiving bare wire the rounded shoulder portion providing a mandrel about which the wire may be bent into curved form to be accepted under a binding screw.

* * * * *